US011193359B1

(12) United States Patent
Hardin et al.

(10) Patent No.: US 11,193,359 B1
(45) Date of Patent: Dec. 7, 2021

(54) TREATMENT OF SUBTERRANEAN FORMATIONS

(71) Applicant: NanoGas Technologies Inc, Deerfield, IL (US)

(72) Inventors: Jeffrey K Hardin, Wilmette, IL (US); Scott A Fiedler, Palantine, IL (US)

(73) Assignee: NANOGAS TECHNOLOGIES INC., Deerfield, IL (US)

( * ) Notice: Subject to any disclaimer, the term of this patent is extended or adjusted under 35 U.S.C. 154(b) by 194 days.

(21) Appl. No.: 16/127,665

(22) Filed: Sep. 11, 2018

Related U.S. Application Data

(60) Provisional application No. 62/557,445, filed on Sep. 12, 2017.

(51) Int. Cl.
*E21B 43/16* (2006.01)
*E21B 43/40* (2006.01)

(52) U.S. Cl.
CPC ..... *E21B 43/164* (2013.01); *E21B 43/166* (2013.01); *E21B 43/40* (2013.01)

(58) Field of Classification Search
CPC ..... E21B 43/164; E21B 43/166; E21B 43/40
See application file for complete search history.

(56) References Cited

U.S. PATENT DOCUMENTS 1,249,232 A * 12/1917 Squires ..... E21B 43/18 166/266
1,658,305 A * 2/1928 Russell ..... E21B 43/16 166/401
2,262,428 A 11/1941 Tempelaar
2,740,478 A 4/1956 Greene
2,875,833 A 3/1959 Martin
3,065,790 A 11/1962 Holm
3,136,361 A 6/1964 Marx
3,208,519 A 9/1965 Moore
3,278,233 A 10/1966 George et al.
3,451,477 A 6/1969 Kelley
3,469,630 A 9/1969 Hurd et al.
3,498,378 A 3/1970 Stone et al.
3,530,937 A 9/1970 Bernard
3,560,053 A 2/1971 Ortloff
3,599,716 A 8/1971 Thompson
3,617,152 A 11/1971 Cummings
3,653,438 A 4/1972 Wagner
3,748,828 A 7/1973 Lefebvre
3,794,114 A 2/1974 Brandon
3,915,234 A 10/1975 Pelofsky
(Continued)

FOREIGN PATENT DOCUMENTS

CN 203948078 11/2014
WO 1992002708 A1 2/1992
WO 2014075191 A1 5/2014

OTHER PUBLICATIONS

ISR/WO for PCT/US2017/032862 (Aug. 7, 2017).

*Primary Examiner* — Steven A MacDonald
(74) *Attorney, Agent, or Firm* — Gregory D. Degrazia; Marina N. Saito; Miller, Canfield, Paddock and Stone PLC

(57) ABSTRACT

Herein are provided tools and processes for extracting oil from subterranean formation. The processes can include lightening the oil in the formation prior to extraction by the addition of a nanogas solution. The tools include injectors for the formation of the nanogas solution within the subterranean formation.

23 Claims, 5 Drawing Sheets

(56) References Cited

U.S. PATENT DOCUMENTS 4,033,411 A 7/1977 Goins
4,192,742 A 3/1980 Bernard et al.
4,212,354 A 7/1980 Guinn
4,788,020 A 11/1988 Yampolsky et al.
5,129,457 A 7/1992 Sydansk
5,403,473 A 4/1995 Moorehead et al.
5,725,054 A 3/1998 Shayegi et al.
6,105,672 A * 8/2000 Deruyter ..... E21B 43/16 166/270.1
6,209,855 B1 4/2001 Glassford
6,656,366 B1 * 12/2003 Fung ..... B08B 9/055 210/737
6,689,262 B2 2/2004 Senkiw
7,008,535 B1 3/2006 Spears et al.
7,059,591 B2 * 6/2006 Bortkevitch ..... B01F 3/0446 261/76
7,294,278 B2 11/2007 Spears et al.
7,537,200 B2 5/2009 Glassford
7,730,958 B2 6/2010 Smith
8,002,038 B2 8/2011 Wilson
8,276,888 B2 10/2012 Osborn et al.
8,500,104 B2 8/2013 Spears et al.
8,523,151 B2 9/2013 Tsuji
8,959,991 B2 * 2/2015 Pissarenko ..... E21B 49/008 73/152.39
9,133,700 B2 * 9/2015 Lissianski ..... E21B 43/164
9,234,407 B2 1/2016 Meyer
9,527,046 B1 12/2016 Roe
9,586,186 B2 3/2017 Roe
2003/0037928 A1 2/2003 Ramachandran et al.
2007/0051513 A1 3/2007 Heins
2007/0143025 A1 6/2007 Valdez et al.
2008/0061006 A1 * 3/2008 Kerfoot ..... C01B 13/10 210/760
2008/0236398 A1 10/2008 Zhang et al.
2008/0237141 A1 10/2008 Kerfoot
2009/0194280 A1 8/2009 Gil et al.
2009/0202304 A1 * 8/2009 Koide ..... B01D 53/62 405/129.2
2009/0234225 A1 9/2009 Martin et al.
2010/0012331 A1 1/2010 Larter et al.
2011/0017456 A1 * 1/2011 Koide ..... B01F 3/0865 166/305.1
2011/0100632 A1 * 5/2011 Dinariev ..... E21B 47/10 166/305.1
2011/0127682 A1 6/2011 Burns et al.
2012/0228404 A1 9/2012 Richardson
2013/0092626 A1 4/2013 Zimmerman et al.
2013/0118977 A1 5/2013 Eppink et al.
2013/0199774 A1 8/2013 Sultenfuss et al.
2013/0233782 A1 9/2013 Eppink et al.
2013/0312980 A1 * 11/2013 Stoisits ..... E21B 43/166 166/357
2013/0341012 A1 * 12/2013 Belani ..... E21B 47/11 166/250.12
2014/0000357 A1 1/2014 Pissarenko et al.
2014/0041867 A1 2/2014 Belgrave
2014/0048494 A1 2/2014 Simmons
2014/0113841 A1 4/2014 Shirley et al.
2014/0158631 A1 6/2014 Govind et al.
2016/0054729 A1 2/2016 Payette et al.
2017/0051588 A1 * 2/2017 Elmer ..... E21B 43/122
2018/0073336 A1 * 3/2018 Hardin ..... B01F 5/0648

* cited by examiner

TREATMENT OF SUBTERRANEAN FORMATIONS

CROSS-REFERENCE TO RELATED APPLICATIONS

This disclosure claims the benefit of priority to U.S. Prov. Application No. 62/557,445, filed Sep. 12, 2017, which is incorporated herein in its entirety.

FIELD OF THE INVENTION

This disclosure is directed to tools and methods for extracting hydrocarbons from subterranean formations.

BACKGROUND

In the recovery of oil from a subterranean hydrocarbon-bearing formation, it is possible to recover only a portion of the oil in the formation using primary recovery methods that utilize the natural formation pressure to produce the oil. A portion of the oil that cannot be produced from the formation using primary recovery methods may be produced by improved or enhanced oil recovery (EOR) methods. Improved oil recovery methods include waterflooding.

Typically, further oil is produced from the formation after primary recovery by injecting water into the formation to mobilize oil for production from the formation. The injected water may drive a portion of the oil in the formation to a well for production from the formation. Oil not produced from the formation may be trapped within pores in the formation by capillary action of water extending across the pore throats of the pores. As a result, a significant quantity of oil located in the portions of the formation may be left in the formation and not recovered by the waterflood.

Improvements to methods of recovering oil from a hydrocarbon-bearing formation including those having oil trapped by water within pores of the formation are desirable.

SUMMARY

A first embodiment is a process that includes extracting a hydrocarbon from a subterranean formation that has been charged with a nitrogen-nanogas solution.

A second embodiment is a process of oil recovery that includes injecting a nanogas solution into a subterranean formation; admixing the nanogas solution and oil in the subterranean formation; forming a lightened oil that has a reduced viscosity and/or density; carrying the lightened oil to a wellbore; and extracting the lightened oil from the wellbore.

A third embodiment is a downhole nozzle assembly for use in a borehole of a well, that can include a body configured for receipt in the borehole, the body including a proximal end, a terminal end opposite the proximal end, and a longitudinal axis; a conduit extending through the main body along the longitudinal axis, the conduit configured to be attached to a pipe and convey a pressurized fluid stream therethrough; a nozzle in fluid communication with the conduit, the nozzle including a plurality of alternating flow regions configured to produce a nanogas solution from the pressurized fluid stream; and an exit opening in fluid communication with the nozzle, the exit opening configured to permit the nanogas solution to exit the body and enter the bore hole.

A fourth embodiment is nanogas delivery system that includes at least one nozzle assembly that has a body configured for receipt in the borehole, the body including a proximal end, a terminal end opposite the proximal end, and a longitudinal axis; a conduit extending through the main body along the longitudinal axis, the conduit configured to be attached to a pipe and convey a pressurized fluid stream therethrough; a nozzle in fluid communication with the conduit, the nozzle including a plurality of alternating flow regions configured to produce a nanogas solution from the pressurized fluid stream; and an exit opening in fluid communication with the nozzle, the exit opening configured to permit the nanogas solution to exit the body and enter the bore hole.

A fifth embodiment is process that includes withdrawing a portion of a subterranean water; forming a pressurized admixture of a gas and the subterranean water; then converting the pressurized admixture to a nanogas solution which includes nanobubbles and water; injecting the nanogas solution into a subterranean formation until the subterranean water includes a minimum concentration of nanobubbles; and then extracting a hydrocarbon from the subterranean formation.

A sixth embodiment is a process that includes injecting a first nanogas solution into a subterranean formation until a subterranean water includes a minimum concentration of nanobubbles that is at least 0.01% of a concentration of nanobubbles in the first nanogas solution; and then pressurizing the subterranean formation with a second nanogas solution; and thereafter extracting a hydrocarbon from the subterranean formation.

A seventh embodiment is a process that includes withdrawing a portion of a subterranean water that includes solids and salts; separating the solids from the subterranean water while leaving the salts; then forming a pressurized admixture of a gas and the separated subterranean water; then converting the pressurized admixture to a nanogas solution which includes nanobubbles and water; injecting the nanogas solution into a subterranean formation until the subterranean water includes a minimum concentration of nanobubbles that is at least 0.01% of a concentration of nanobubbles in the nanogas solution; and then extracting a hydrocarbon from the subterranean formation.

BRIEF DESCRIPTION OF THE FIGURES

For a more complete understanding of the disclosure, reference should be made to the following detailed description and accompanying drawing figures wherein.

Figure 1:
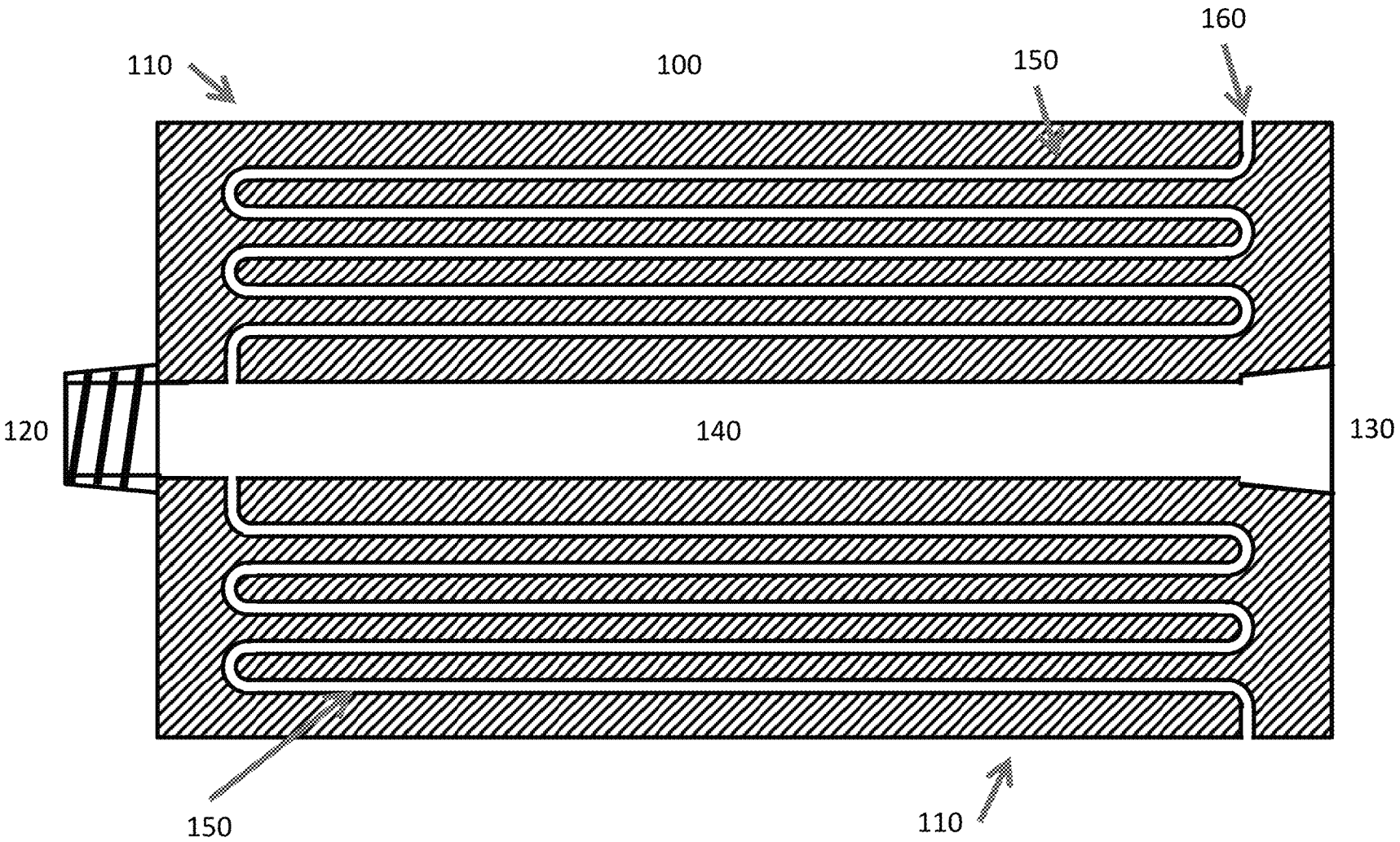
FIG. 1 is a cross-section of a nozzle assembly showing two nozzles connected to a fluidic channel.

While specific embodiments are illustrated in the figures, with the understanding that the disclosure is intended to be illustrative, these embodiments are not intended to limit the invention described and illustrated herein.

DETAILED DESCRIPTION

A first embodiment is a process of extracting a hydrocarbon from a subterranean formation that has been charged with a nanogas solution. Herein, the hydrocarbon extracted from the subterranean formation is typically crude oil. In some instances, the hydrocarbon is a heavy crude oil, where the isolated oil has an API gravity of less than 10°, preferably 8° to 10°. In other instances, the hydrocarbon is a medium and or light crude oil. Preferably, the hydrocarbon is extracted without carrying solids from the subterranean formation. Notably, the subterranean formation can be any oil reserve, for example, mixtures of oil and gas formations, shale formations, and oil sands formations.

The nanogas solution is a homogeneous mixture of nanobubbles and water. As used herein, the term "nanobubbles" means bubbles of a gas within a liquid, wherein the bubbles having an average diameter of about 10 nm to 100 nm; preferably, wherein there are no bubble having a diameter of greater than about 500 nm, about 400 nm, about 300 nm, about 250 nm, or about 200 nm, more preferably, there are no microbubbles. Nanogas solutions have been formed in or by a nanogas solution generator, one example of which is provided in U.S. Pat. No. 9,586,176 which is incorporated herein in its entirety, an additional generator is described in U.S. Pat. No. 8,500,104.

The nanogas solution is preferably homogeneous, that is, the nanobubbles are evenly distributed throughout the solution and appear as a suspended "particulate" in the liquid. Notably, the liquid may further be saturated with or near saturation with the gas that comprises the nanobubbles. A mixture of bubbles and liquid wherein the bubbles coalesce and/or rise to the surface and break is not a homogeneous mixture of nanobubbles and the liquid.

The nanogas solution can include nanobubbles that include, consist essentially of, or consist of oxygen ($O_2$), nitrogen ($N_2$), carbon dioxide ($CO_2$), or a mixture thereof; and can include a liquid that is water, for example, distilled water, di-water, ground water, municipal water, collected water, produced water, or recycled water. As used herein, the terms oxygen and nitrogen refer to the gasses $O_2$ and $N_2$ whether or not the term oxygen gas or nitrogen gas is used.

In one instance, the nanogas solution includes collected water; as used herein collected water means the water that has been used in the oil industry for the hydraulic fracturing of subterranean formations, well stimulation or treatment, specifically water that has been collected from a subterranean use. In another instance the nanogas solution includes produced water; as used herein produced water means the water that has been collected from a subterranean formation (e.g., coming naturally from a formation that contains oil or solids). In yet another instance, the nanogas solution includes recycled water, as used herein recycled water means collected water which has been processed to remove oil and solids.

In yet another instance the nanogas solution includes oxygen, nitrogen, carbon dioxide, or a mixture thereof. In one example, the nanogas solution is a nitrogen-nanogas solution wherein the solution includes, consists essentially of, or consists of nitrogen ($N_2$) and the water. Herein, the term consists essentially of refers to the inclusion of salts, gases, or solutes that may occur in the water (liquid) but have no effect on the performance of the nanogas solution in the herein disclosed processes. Notably, unless rigorously cleaned and degassed, water will always include some concentration of contaminants (solutes and gases). Furthermore, the term consisting essentially of includes the use of recycled water for the formation of the nanogas solution; in this instance, the solution will consist of the gas, water ($H_2O$), and minor concentrations of compounds found in the emulsion from which the recycled water was obtained. Herewith, the nanogas solution preferably consists essentially of the gas and water, wherein the contaminants in the water do not affect the performance of the solution. In another example, the nanogas solution is an oxygen-nanogas solution wherein the solution includes, consists essentially of, or consists of oxygen and water. In still another example, the nanogas solution is a ON-nanogas solution wherein the solution includes, consists essentially of, or consists of oxygen, nitrogen, and water. Herein, an ON-nanogas includes molar ratios of oxygen to nitrogen of 99:1 to 1:99, for example 99:1, 90:1, 80:1, 70:1, 60:1, 50:1, 40:1, 30:1, 20:1, 10:1, 1:1, 1:10, 1:20, 1:30, 1:40, 1:50, 1:60, 1:70, 1:80, 1:90, and 1:99. Preferred molar ratios include about 18:82, 21:79, 28:72, 30:70, 32:68, 35:65, 40:60, 42:58, and 50:50. Other particularly relevant molar ratios can be selected from 50:50; 60:40; 70:30; and 80:20. In yet still another example, the nanogas solution includes carbon dioxide wherein the solution includes, consists essentially of, or consists of carbon dioxide and water, more preferably a mixture of carbon dioxide, nitrogen, and water.

Preferably, the subterranean formation has been charged with a nitrogen-nanogas solution. That is, prior to or concurrent with extraction the subterranean formation was charged with a nitrogen-nanogas solution. In another preferable instance, the subterranean formation had been charged with a carbon dioxide nanogas solution. Even more preferably, the subterranean formation was charged with a nitrogen-nanogas solution and a carbon dioxide nanogas solution prior to extraction of the hydrocarbons.

Herein, the extraction of the hydrocarbon can be during a secondary production phase (secondary recovery); and/or during a tertiary production phase (Enhanced Oil Recovery "EOR"). Notably, during a tertiary production phase, the subterranean formation can be charged with the nanogas solution prior to or concurrent with standard EOR processes.

In another instance, the process includes injecting into the subterranean formation the nitrogen-nanogas solution and can include injecting into the subterranean formation a carbon dioxide nanogas solution. Notably, the nitrogen and the carbon dioxide solutions can be co-injected or separately injected in the subterranean formation. The separate injection can include temporal or location distinctions, that is, the nitrogen and carbon dioxide solutions can be injected at the same time but at different locations and/or one solution can be injected earlier than the other. In one instance, multiple injections of the solutions can incur with alternating solution compositions. In one preferable instance, the nitrogen-nanogas solution is co-injected into the subterranean formation with a carbon dioxide nanogas solution.

Herein, the injection of the nanogas solution into the subterranean formation includes providing a pressurized admixture of the gas and water to an injection nozzle positioned within the subterranean formation. Notably, the nanogas solution utilized herein is manufactured, made, or generated downhole (i.e., within the subterranean formation) and is not produced above ground. Accordingly, in one instance, a pressurized admixture of nitrogen and water is provided to an injection nozzle positioned within the subterranean formation wherein the injection nozzle converts the pressurized admixture into a nanogas solution. In another instance, the pressurized admixture includes carbon dioxide. In yet another instance, the pressurized admixture includes a salt, preferably salt or salts that prevent the dissolution of the formation and/or assist in the disruption of the hydrocarbon from the formation.

In one instance the process can include conveying the pressurized admixture of nitrogen and water through a pipe from an above-ground proximal end of the pipe to a downhole terminal end of the pipe, wherein the terminal end is disposed in the subterranean formation. Then subjecting the pressurized admixture to a plurality of alternating flow regions in a tool in communication with the pipe and disposed at or near the terminal end of the pipe, wherein the flow regions each include a plurality of laminar flow regions and turbulent flow regions configured to produce a nanogas solution from the pressurized admixture. Then, forming a nanogas solution in the tool, and injecting the nanogas solution from the tool into the formation.

In another instance, the process can include collecting a mixture of the hydrocarbon and water from the subterranean formation; and separating the hydrocarbon and the water. The process of separating the hydrocarbon and the water can include providing the mixture to a separation tank (e.g., a float tank) for a density based separation; can include the addition of an additional nanogas solution to facilitate breaking an emulsion in the mixture; and or dewatering the solution through chemical, mechanical, or thermal processes.

Another embodiment is a process of oil recovery that includes injecting a nanogas solution into a subterranean formation; admixing the nanogas solution and oil in the subterranean formation; forming a lightened oil that has a reduced viscosity and/or density; carrying the lightened oil to a wellbore; and extracting the lightened oil from the wellbore. In one instance, the nanogas solution includes a nitrogen-nanogas solution; in another instance, the nanogas solution includes nitrogen and carbon dioxide.

Preferably, the nanogas solution is injected into the subterranean formation by carrying a pressurized admixture of a gas and water to an injection nozzle positioned within the subterranean formation; passing the pressurized admixture through a tube that includes plurality of alternating flow regions within the injection nozzle; and then ejecting the nanogas solution from the injection nozzle. The injection nozzle, preferably, includes a plurality of tubes, each including a plurality of alternating flow regions and the pressurized admixture is, preferably, passed through this plurality of tubes. In one instance, the nanogas solution is injected into the subterranean formation by carrying a pressurized admixture of a gas and water through a pipe from an above-ground proximal end of the pipe to a downhole terminal end of the pipe, wherein the terminal end is disposed in the subterranean formation. The pressurized admixture is then subjected to a plurality of alternating flow regions in a tool in communication with the pipe and disposed at or near the terminal end of the pipe, wherein the alternating flow regions are configured to produce a nanogas solution from the pressurized admixture. The nanogas solution is then formed in the tool and, finally, is injected from the tool into the formation.

In another instance, the oil recovery is an EOR process that includes carbon dioxide flooding of the subterranean formation. In one preferable example, the oil recovery includes both carbon dioxide flooding and injection of the nanogas solution. In another preferable example, the process includes alternating the carbon dioxide flooding and the injection of the nanogas solution, providing a plurality of both.

The process includes lightening the oil in the subterranean formation. Herein, this means, the density and/or viscosity of the oil in the formation is changed to facilitate the movement of the oil in the formation. Preferably, the density and/or the viscosity is/are decreased. Once the oil is lightened, this lightened oil is carried to a wellbore (extraction point) and removed from the subterranean formation. Preferably, the extracted lightened oil includes a lower concentration of solids, asphaltenes, paraffins, resins, and mixtures thereof than oil extracted from the subterranean formation prior to the addition of the nanogas solution. In one example, the concentration of solids, asphaltenes, paraffins, resins, and mixtures thereof is decreased by at least 5%, 10%, 15%, 20%, 25%, 30%, 35%, 40%, 45%, or 50%. In another instance, the extracted lightened oil can have an API above 23°, preferably above 25°, above 27°, or above 30°. That is, the weight of the oil extracted from the subterranean formation, when measured without additional steps following the extraction, has an API, preferably above 23°. Notably, the extracted lightened oil can be further processed to remove additional solids, gases, and water to provide the crude oil. This crude oil can have an API that is less than 22°, that is the crude oil is a heavy oil. In one instance, this heavy oil has an API less than 22°, less than 20°, less than 18°, less than 16°, less than 14°, or less than 12°.

In another instance the lightened oil carried from the wellbore is an admixture of water and oil. The water preferably includes a concentration of nanobubbles (e.g., nitrogen nanobubbles). The oil can include a concentration of carbon dioxide dissolved therein. Preferably the lightened oil includes a concentration of carbon dioxide but is collected from the wellbore with a minimum (less than 50 wt. %, 40 wt. %, 30 wt. %, 20 wt. %, 10 wt. % or 5 wt. %) of water. More preferably, when water is extracted from the wellbore with the lightened oil this mixture does not include an oil-in-water emulsion. That is, the addition of the nitrogen nanogas solution suppresses or prevents the formation of an oil-in-water emulsion in the subterranean formation and decreases or prevents the collection of the oil-in-water emulsion from the wellbore.

Importantly, the machines and processes provided herein provide nanogas solutions without macrobubbles and/or without the formation of macrobubbles. Preferably, none of the nanogas solutions utilized herein form or include macrobubble (i.e., any bubble larger than a nanobubble).

In another instance, the tool described herein can be utilized for addition of a nanogas solution to oil sands tailings held in a tailings pond. That is, the tool can be utilized for the subsurface injection of the nanogas solution into the tailings below the surface of the tailings pond. In a preferable example, the addition of the nanogas solution (e.g., a nitrogen-nanogas solution) to the tailings pond increases the rate of separation of the oils, water, and solids contained in the tailings. In another preferable example, the addition of a nanogas solution that includes oxygen (e.g., an oxygen-nanogas solution or an ON-nanogas solution) and oxidizes hydrogen sulfide and/or other oxidizable components of the tailings solution. In one example, the addition of an oxygen including nanogas solution additionally causes hydrocarbon materials to agglomerate and increase separation; in another example, the addition of a nitrogen nanogas solution separates and lightens the oil(s) and allows for more facile removal of the hydrocarbons from the surface of the tailings pond. Preferably, the addition of the nanogas solution increases the settling rate by a factor of 1.1, 1.2, 1.3, 1.4, 1.5, 1.6, 1.7, 1.8, 1.9, or 2.0. More preferably, the addition of the nanogas solution increases the settling rate by at least 2 times.

In a particular instance, the method can include admixing a nanogas solution with oil sands tailings and then separating materials including silts, residual bitumen, and organic compounds from water in the oil sands tailings. In this instance, the nanogas solution includes nitrogen nanobubbles, oxygen nanobubbles, carbon dioxide nanobubbles or a mixture thereof. In one case, the nanogas solution is a nitrogen-nanogas solution. In another case, the viscosity of oil in the tailings is reduced as an effect of the addition of the nanogas solution. In yet another case the process includes further admixing an oxygen-nanogas solution with the oil sands tailings; and oxidizing a sulfide. The process can includes admixing the nanogas solution with the tailings and then adding the admixture to a tailings pond; can include subservice injection and admixing of the nanogas solution and the tailings, for example the subsurface injection of the nanogas solution into tailings held in a tailings pond.

That is, the tool can be utilized for the subsurface injection of the nanogas solution into the tailings below the surface of the tailings pond. In a preferable example, the addition of the nanogas solution (e.g., a nitrogen-nanogas solution) to the tailings pond increases the rate of separation of the oils, water, and solids contained in the tailings. In another preferable example, the addition of a nanogas solution that includes oxygen (e.g., an oxygen-nanogas solution or an ON-nanogas solution) and oxidizes hydrogen sulfide and/or other oxidizable components of the tailings solution. In one example, the addition of an oxygen including nanogas solution additionally causes hydrocarbon materials to agglomerate and increase separation; in another example, the addition of a nitrogen nanogas solution separates and lightens the oil(s) and allows for more facile removal of the hydrocarbons from the surface of the tailings pond.

In still another embodiment, the tool described herein can be utilized for addition of a nanogas solution to landfills. The addition of the nanogas solution can be to a bioreactor landfill, an aerobic landfill, an anaerobic landfill, or a hybrid landfill. Notably, the addition of an oxygen containing nanogas solution to a hybrid or anaerobic landfill can convert the landfill to a bioreactor or aerobic landfill. Preferably, the nanogas solution includes a percentage of oxygen (is an oxygen-nanogas solution or an ON-nanogas solution) that promotes aerobic digestion in the landfill, decreases the methanogenesis in the waste, and decreases methane emissions from the landfill.

An ON-nanogas solution is a solution that includes, consists essentially of, or consists of oxygen ($O_2$), nitrogen ($N_2$), and water. Herein, an ON-nanogas includes molar ratios of oxygen to nitrogen in the range of 99:1 to 1:99; examples include 99:1, 90:1, 80:1, 70:1, 60:1, 50:1, 40:1, 30:1, 20:1, 10:1, 1:1, 1:10, 1:20, 1:30, 1:40, 1:50, 1:60, 1:70, 1:80, 1:90, and 1:99. Preferred molar ratios include about 18:82, 21:79, 28:72, 30:70, 32:68, 35:65, 40:60, 42:58, and 50:50. One particularly relevant molar ratio is 21:79 (air). Other particularly relevant molar ratios can be selected from 50:50; 60:40; 70:30; and 80:20. In particular, the amount of oxygen (relative to the amount of nitrogen) can be varied to achieve different results, and the higher the concentration of the composition that is desired to be oxidized the higher the oxygen concentration can be. In one instance, the addition of the oxygen nanogas solution to the landfill promotes the oxygenation of sulfides in the landfill and the reduction of noxious gases from the waste mass.

Another embodiment, useful in the processes described herein, is a downhole nozzle assembly 100 for use in a borehole of a well (FIG. 1). The nozzle assembly 100 preferably includes a body 110 configured for receipt in the borehole, the body including a proximal end 120, a terminal end 130 opposite the proximal end 120, and a longitudinal axis. The assembly further includes a conduit 140 extending through the main body along the longitudinal axis, the conduit configured to be attached to a pipe and convey a pressurized fluid stream therethrough. In one instance, the nozzle assembly includes a nozzle 150 in fluid communication with the conduit, the nozzle 150 including a plurality of alternating flow regions configured to produce a nanogas solution from the pressurized fluid stream. In another instance, the nozzle assembly includes a plurality of capillary tubes in fluid communication with the conduit and configured to produce a nanogas solution from the pressurized fluid stream. The nozzle assembly further includes an exit opening 160 in fluid communication with the nozzle or capillary tubes, the exit opening configured to permit the nanogas solution to exit the body and enter the bore hole.

In one instance, the alternating flow regions of the nozzle assembly are laminar flow regions and turbulent flow regions. In another instance, the alternating flow regions of the nozzle assembly are substantially linear and radially bent flow regions. Herein, the substantially linear flow regions, preferably, provide laminar flow and the radially bent flow regions, preferably, provide turbulent flow. The substantially linear regions or the laminar flow regions can be oriented along the longitudinal axis or these regions can be oriented at an angle relative to the longitudinal axis (e.g., at an angle of about 0° to about 45° relative to the longitudinal axis). Preferably, these regions are substantially parallel in the nozzle assembly. In another instance, the alternating flow regions are distinguished by their respective calculated Reynolds numbers which differ by at least 500, 1000, 1500, or 2000. In still another instance, the alternating flow regions are a first radially bent flow region and a second radially bent flow region; where these two radially bent flow regions can have an arc angle that is substantially similar (e.g., about 180°) but have significantly (e.g., factor of at least 2, 3, 4, 5, 6, 7, 8, 9, or 10) larger arc length and arc radius; preferably the arc radii differ by at least a factor of 5, more preferably a factor of 10.

Figure 3:
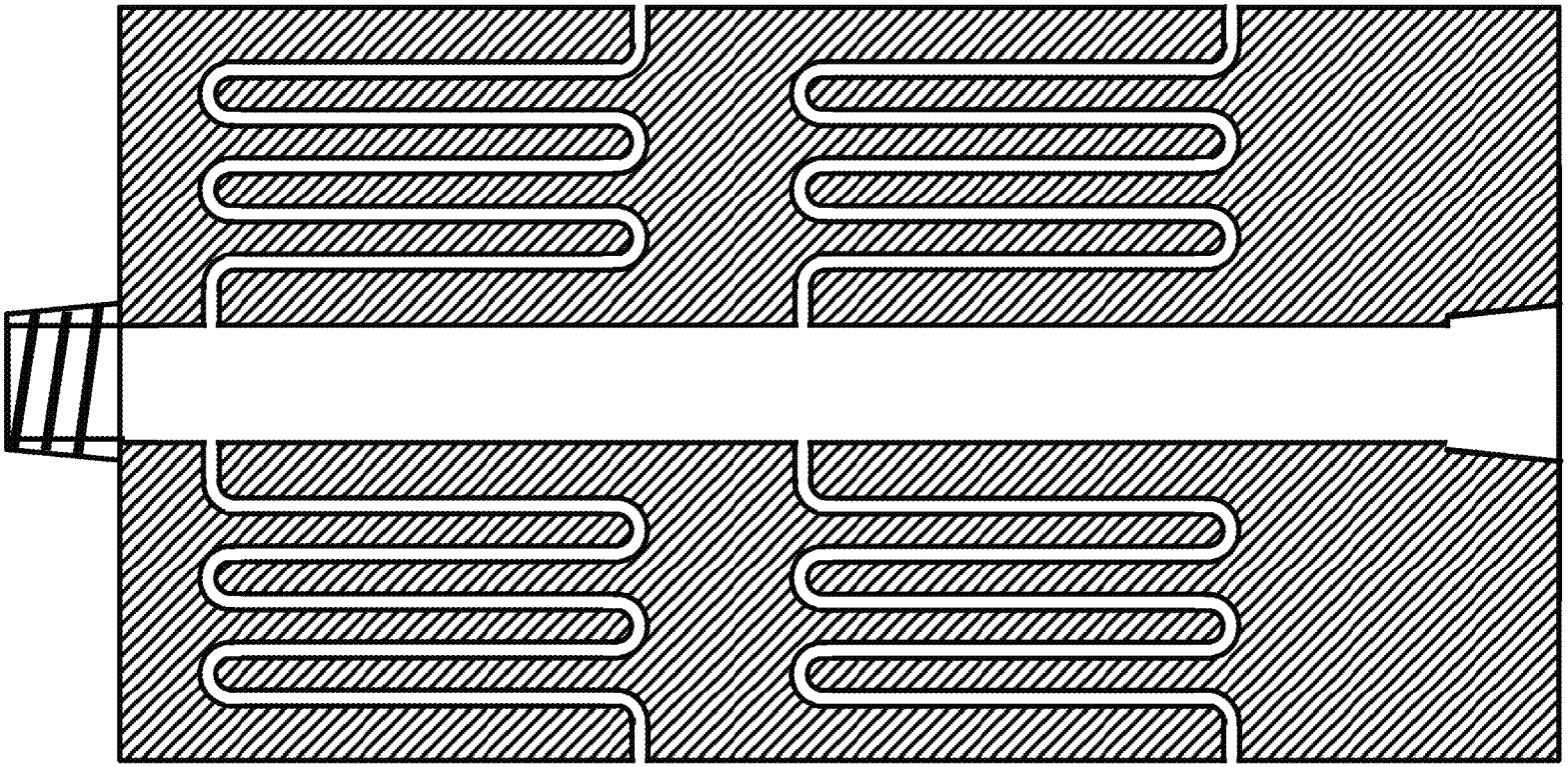
FIG. 3 is a cross-section of a nozzle assembly having multiple sets of radially positioned nozzles.

The nozzle assembly 100, preferably, includes a plurality of nozzles 150, each in fluid communication with one of a plurality of exit openings 160. That is, the nozzle assembly includes a plurality of substantially identical nozzles extending from the conduit to the exit openings and configured to produce a plurality of nanogas solution streams. In one instance, the nozzle assembly can include four nozzles arranged in a spaced apart configuration, wherein each of the plurality of nozzles extends from the conduit to an outer wall of the body. When there are four nozzles, the nozzles, preferably, extend radially at about 90 degree increments from the conduit. In other instances, the plurality of nozzles can include 2, 3, 4, 5, 6, 7, 8, 9, or 10 nozzles—the limitation being the radially available space. In yet another instance shown in FIG. 3, the nozzle assembly can have multiple sets of pluralities of radially spaced nozzles, where each set is spaced along the longitudinal axis of the nozzle assembly. In one example, the nozzle assembly can have two sets of four nozzles (eight total), where the two sets are spaced along the longitudinal axis, and the four nozzles in each set are radially spaced. The two sets can include nozzles having radially similar locations, or the nozzles in one set can be offset relative to another set. Preferably and for simplicity in manufacture, the sets are stacked, or positioned longitudinally without any radial distinction.

Due to the nature of the borehole, the body of the nozzle assembly is, preferably, cylindrical. While other shapes are imagined, including square (with four radially spaced nozzles), hexagonal (with six radially spaced nozzles), and octagonal (with eight radially spaced nozzles), the cylindrical nature of the borehole (and coiled tubing which can carry the nozzle assembly downhole) provides a preference for the cylindrical shape.

The nozzle assembly, in particular the body, is preferably formed of stainless steel; notably the body and parts utilized herein are preferably made of stainless steel but can be optionally made of or include other metals or ceramics that are compatible with the process of forming the nanogas solution and the subterranean environment. In one instance, the nozzle assembly includes or consists of a plurality of stainless steel pieces assembled and welded or brazed. In another instance, the nozzle assembly includes a plurality of stainless steel support pieces in intimate contact with a stainless steel tube arranged (e.g., bent or shaped) to be a nozzle. For example, the nozzle assembly can include at least two stainless steel body pieces that have matching half-cylindrical contours cut into the opposing surfaces. When assembled (matched) these two half-cylindrical contours can form a flow path from the conduit to the exit opening. To minimize fluidic disturbances in the assembled piece a stainless steel tube can be positioned within volume created by the two half-cylindrical contours. In another instance, the body can include an outer tube carrying the exit openings and the conduit extending through the outer tube along a longitudinal axis (a pipe within a pipe). In this instance, a plurality of tubes (preferably, stainless steel tubes) connect the conduit to the exit openings. Notably, this instance can include an internal volume between the outer tube and the conduit wherein the plurality of tubes traverse. Preferably, this internal volume is filled to support the nozzle assembly at the pressures encountered within a subterranean formation. In one instance, the internal volume is filled with stainless steel. In another instance, the internal volume is filled with a ceramic, for example a concrete, a clay ceramic, an inorganic metal oxide, or a plastic ceramic. Notably, the nozzle assembly can be formed from the outer tube, conduit, and plurality of tuber (nozzles), and then the ceramic poured into the internal volume, cured and/or set according to the procedures needed to harden and form the ceramic. The stainless steel tube can have an inside diameter in the range of about 0.5 mm to about 100 mm, about 1 mm to about 50 mm, about 2 mm to about 25 mm, or about 5 mm to about 20 mm. When supported (preferably in intimate contact throughout its length) the stainless steel tube have a narrow wall thickness, for example the wall thickness can be about 0.1 mm to about 7 mm, preferably about 0.2 mm to about 4.5 mm. Notably, when the ID is less than about 10 mm, the wall thickness is about 0.1 mm to about 1 mm, preferably about 0.1 mm to about 0.5 mm. When the ID is greater than about 10 mm, the wall thickness can be greater than about 0.5 mm but is preferably about 0.2 mm, 0.3 mm, 0.4 mm, 0.5 mm, 0.6 mm, 0.7 mm, 0.8 mm, 0.9 mm, 1 mm, 1.2 mm, 1.5 mm, 1.75 mm, 2 mm, 2.5 mm, 3 mm, or within any range thereof.

Figure 2:
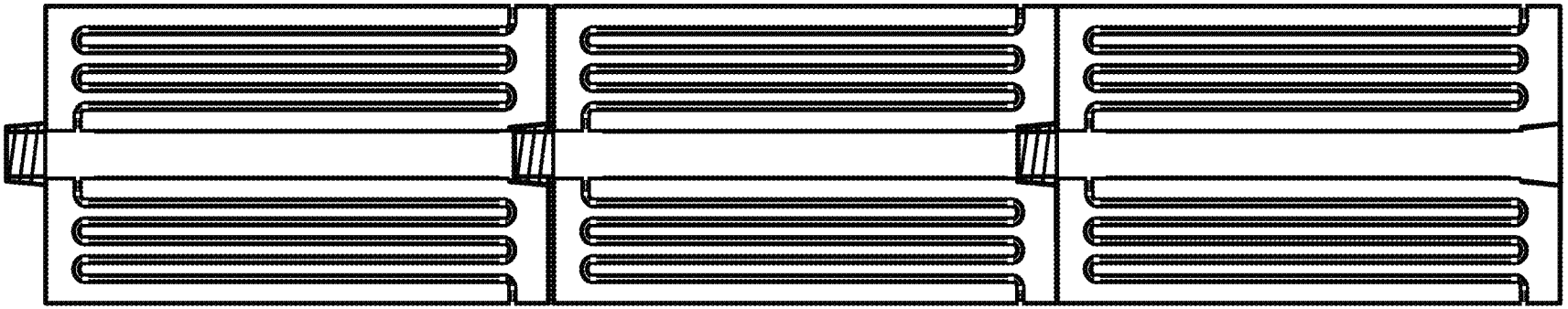
FIG. 2 is a depiction of a plurality of nozzle assemblies connected in-line.

Preferably, each nozzle assembly is configured to be modular and assembled in series with other nozzle assemblies (see FIG. 2). That is, the body of a first nozzle assembly is configured to affix to the body of a second nozzle assembly. While the nozzles assemblies are envisioned as identical units, each nozzle assembly in a series can be the same or different. To facilitate the connection between adjoining nozzles assemblies, the conduit can include an extending portion that extends from, for example, the proximal end and can include interior threads formed at or near the terminal end of the body, the interior threads sized and shaped to threadably connect to the exterior threads of the extending portion. Notably, the position of the extending portion and the interior threads can be reversed and the extending portion can be proximal to the terminal end and the interior threads proximal to the proximal end. In other embodiments, some nozzle assemblies can include interior threads at both the terminal and proximal ends and/or some nozzle assemblies can include extending portions at both the terminal and proximal ends. Preferably, the nozzle assembly includes threads (exterior and interior) shaped to threadably connect to a pipe (e.g., a pipe configured to provide a pressurized admixture to the nozzle assembly).

Figure 4:
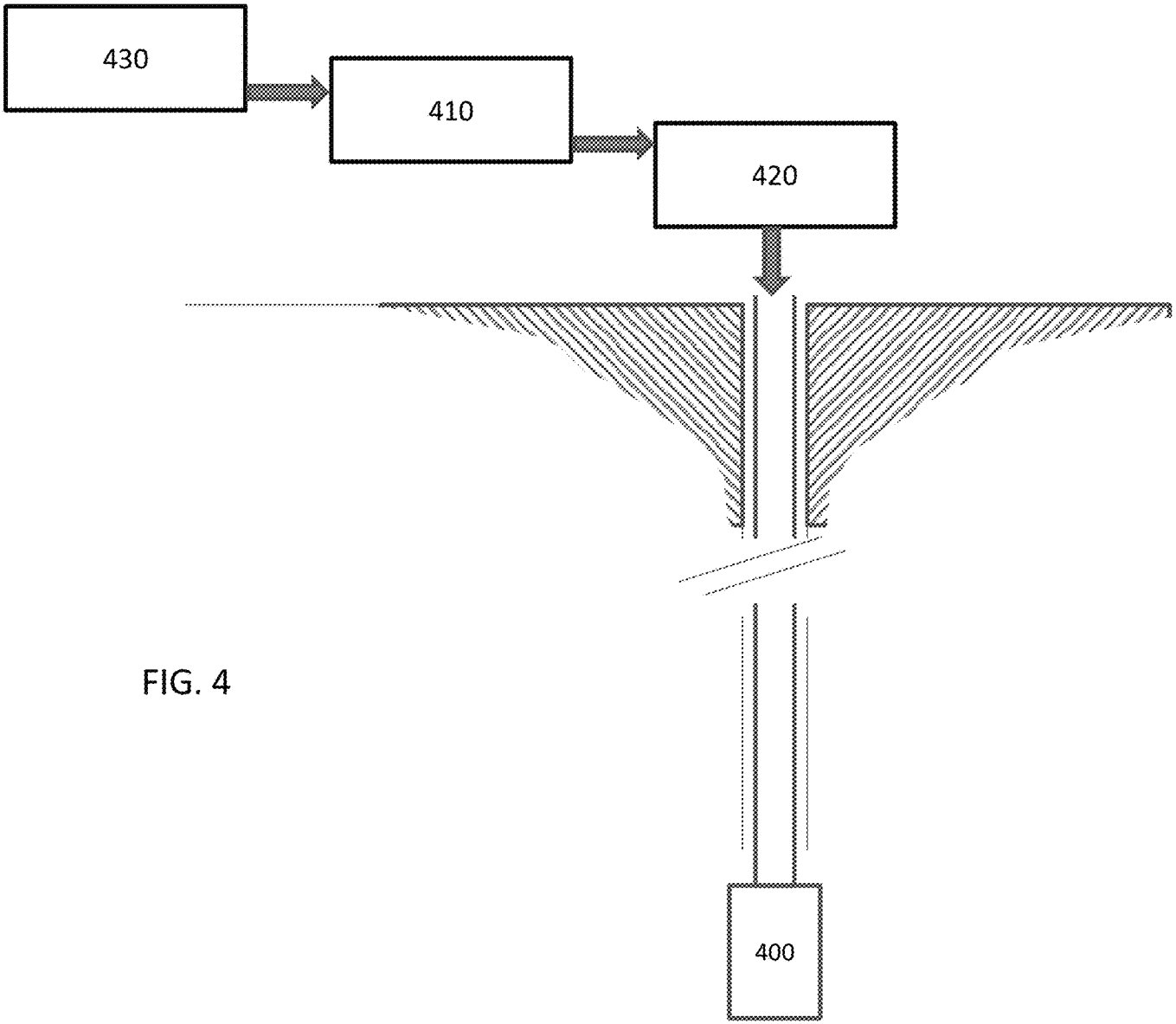
FIG. 4 is a depiction of the nozzle assembly in use in a nanogas delivery system.
Figure 5:
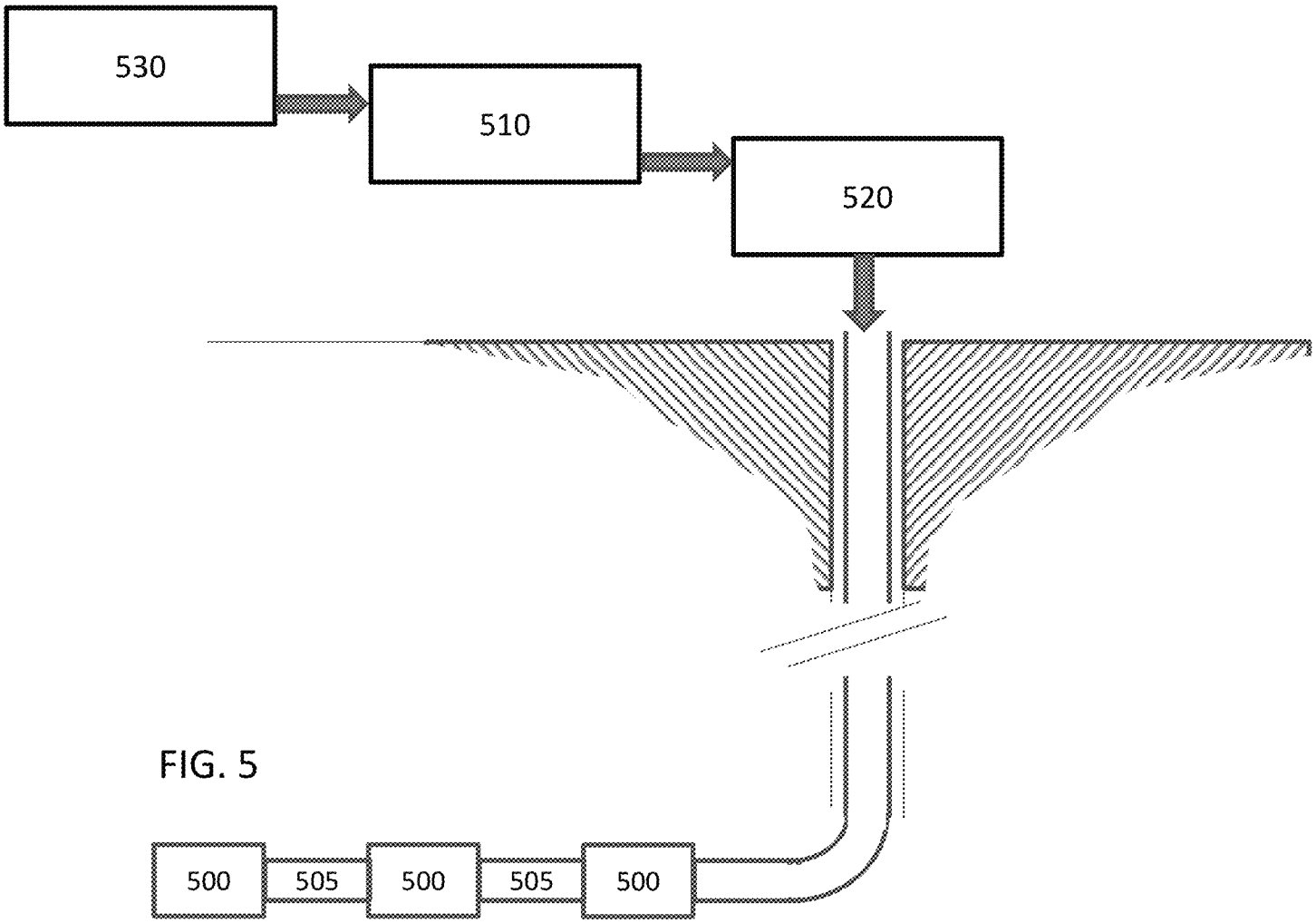
FIG. 5 is a depiction of a plurality of nozzle assemblies in use in a nanogas delivery system.

Yet another embodiment is a nanogas delivery system (FIG. 4) that includes at least one of the above described nozzle assemblies 400. The nanogas delivery system preferably includes at least two fluid pumps in series 410, 420. These pumps configured to supply a pressurized fluid stream (the pressurized admixture) to the nozzle assembly which is configured to convert the pressurized admixture to a nanogas solution. The pumps, preferably, in fluid communication with a pressurized vessel 430 that is configured to supply, at least, the fluid for the pressurized fluid stream (pressurized admixture), and preferably, configured to provide the pressurized admixture of a gas and the fluid. The nanogas delivery system can include a plurality of nozzle assemblies 400 connected in series as shown in FIG. 2 or separated by exterior conduit(s) (as shown in FIG. 5). In one example, the nanogas delivery system can be applied to a vertical borehole (e.g., FIG. 4); in another example, the nanogas delivery system can be applied in a horizontal borehole (e.g., FIG. 5). Preferably, the vertical and horizontal boreholes include a plurality of nozzle assemblies connected in series or separated by exterior conduits. In reference to FIG. 5, a nanogas delivery system can include a plurality of nozzle assemblies 500 spaced through the subterranean formation by a series of fluidly connected exterior conduits 505. The exterior conduits 505 configured to convey the pressurized fluid stream therethrough. The exterior conduits 505 are affixed to the nozzle assemblies 500, for example the exterior conduits 505 can be threadably connected to the interior and/or exterior threads on the nozzle assemblies 500. Other connections are envisioned, including flang connections, camlock couplings, welds, and brazings. This example includes the nozzle assemblies 500 in fluid connection with at least two fluid pumps in series 510, 520 which are in fluid communication with a pressurized vessel 530 configured to supply, at least, the fluid for the pressurized fluid stream (pressurized admixture), and preferably, configured to provide the pressurized admixture of a gas and the fluid. The exterior conduits 505 can be of equal length (or absent) thereby configuring the nanogas delivery system to provide a regularly spaced nanogas solution to the subterranean formation or the exterior conduits 505 can include a plurality of lengths thereby spacing the nozzle assemblies in different subterranean formation or in different sections of one subterranean formation (for example to provide differential pressure within a formation).

While there are known sciences involving the use of gases to extract oil from subterranean formations, the use of nano bubbles expands beyond the current processes and methods of extraction. The science behind the improved performance of the gases in a nano bubble state in a subterranean formation is much different than that of standard gas injection, gas in water injection or water alternating gas injection. Because the science is different, the processes for injection and extraction is also different from what is currently conducted today.

The current use of gases in subterranean formations includes nitrogen, carbon dioxide, and air. The known art of these gases is to inject the gases individually or as a blend into the subterranean formation. This can be done several different ways, gas into water, alternating gas and water, gas injection to a specific pressure and maintaining the gas pressure blanket to retain the gas in formation during production. Regardless, the basic science behind the process is always the same.

All three gases have their own known properties based on ideal gas laws. The performance of these gases when injected in a subterranean formation react differently but all obtain the same basic results to loosen the oil from formation and recover it. However, the use of these gases can be very difficult to perfect and require extensive engineering to achieve the proper reaction in formation. Although the installation, engineering and operation can be very costly, the recovery can be very rewarding when properly done.

Carbon Dioxide—Carbon Dioxide can be miscible in oil or not miscible in oil. It's miscibility is determined by pressure and temperature. It works as a solvent in oil. It performs better in the release of the oil when it goes miscible as opposed to immiscible. It also reacts to water to create a carbonic acid. It will reduce viscosity of the oil, reduce surface tension of the oil and water, reduce interfacial tension, and reduce capillary pressures. Carbon dioxide will increase production when used in a immiscible state but performs much better going miscible in a supercritical state.

Nitrogen—Nitrogen can be miscible in oil or not miscible in oil. It's miscibility is determined by pressure and temperature. It works as a solvent in oil. It performs better in the release of the oil when it goes miscible as opposed to immiscible. It does not react with water. It will reduce viscosity of the oil, reduce surface tension of the oil and water, reduce interfacial tension, and reduce capillary pressures. Carbon dioxide will increase production when used in a immiscible state but performs much better going miscible in a supercritical state.

Air—Air is injected into a formation containing heavy oil. Air is pressured in situ and ignited. The air and hydrocarbons burn causing heat, thus reducing the viscosity of heavy viscous crude oil for extraction from the subterranean formation (Fire Flood Process).

The nano bubble process at standard temperatures and pressures reduces surface tension of a single-phase fluid and interfacial tension between a two-phase liquid. The nano bubbles have a hard outer shell and high internal pressures. The nano bubbles are so small they are held in suspension in the fluids, reducing the surface tension. They have a 15-day half-life. Because of their size, pressures and hardness, they are colloidal. As a colloidal, they respond to the fluid movement in Brownian Motion.

When utilizing nano bubbles to separate oil and water at standard temperature and pressures, the nano bubble solution is mixed with the oil and water influent. In doing so, the influent is saturated at a high rate and concentration. At this high concentration and rate, Brownian Motion is increased.

The action of the Brownian Motion at high saturation levels, drives the nano bubbles into the fluids to include between the oil water phases relieving interfacial tension. The bubbles are small enough and in large volumes, entering the interstitial spaces at the molecular level, separating the oil and water at the droplet level. When this occurs, the emulsions break, and water attracts to water and oil to oil.

A similar process can be applied in subterranean formations where there is oil in the formation, yielding the same emulsion breaking results. However, when applied in formation, you achieve additional outcomes to extract oil from the formation.

The best way to obtain results in formation is to make nano bubbles in the formation instead of at surface level and pumping into the formation. Utilizing the Nano Gas down hole tool, high levels of saturation of gas can be applied down hole in formation prior to starting to flow the water out of formation for production.

Making the bubbles down hole, they will retain their normal size during production. The bubbles will be larger than the ones made on the surface and pumped down hole. When made on the surface, the bubbles will decrease in size when pumped down hole exposing them to heat and pressure (Boyles Law).

In formations such as shale, where the pore sizes are extremely small, the use of the down hole tool may be prohibitive. In such cases, the process may require making the nano bubbles on surface and sending them down hole.

Once the formation is heavily saturated with nano bubbles (can be tested by titration methods), Brownian Motion will have already begun to soften the oil on formation, relieved interfacial and surface tension. The process of recovery of released oil and re-injection of nano bubble saturated water can then begin.

During this phase, the movement of the flow of water within formation will cause the fluid with the bubbles to increase the Brownian Motion through the formation and its pores. The bubbles within the pores will reduce the capillary pressures in the pores thus releasing the oil from the pores. The water and colloidal bubbles will push the loosened oil from the pores for removal from the formation. The constant action and wiping of the oil from the formation by the nano bubbles will allow the oil in the formation to come out into the pore for extraction by osmosis.

One example is a process that can include injecting a nanogas solution, which includes nanobubbles and water, into a subterranean formation until subterranean water includes a minimum concentration of the nanobubbles; and then extracting a hydrocarbon from the subterranean formation. The process can further include a second process of providing the nanogas solution that includes withdrawing a portion of the subterranean water; forming a pressurized admixture of a gas and the subterranean water; and then converting the pressurized admixture to the nanogas solution. Here, the subterranean water can be circulated or recirculated through the process of providing the nanogas solution until the formation includes the minimum concentration of nanobubbles; thereafter extracting the hydrocarbon. Preferably, the minimum concentration of the nanobubbles in the subterranean water is at least 0.01%, 0.05%, 0.1%, 0.5%, 1%, 2.5%, 5%, 7.5%, 10%, 20%, 30%, 40%, or 50% of the concentration of nanobubbles in the nanogas solution.

The process of providing the nanogas solution can further include withdrawing subterranean water to a surface located device wherein the pressurized admixture is formed. In one instance, the surface located device is a nanogas generator or generation machine. In one instance, the pressurized admixture is converted to the nanogas solution by the surface located device; and then the nanogas solution is returned to the subterranean formation. In another instance, the pressurized admixture is converted to the nanogas solution via an injection nozzle positioned within the subterranean formation.

In another instance, the steps of forming a pressurized admixture of a gas and the subterranean water and converting the pressurized admixture to the nanogas solution occur within the subterranean formation.

In still another instance, extracting a hydrocarbon from the subterranean formation includes pressurizing the subterranean formation with a second nanogas solution. Pressurizing the subterranean formation can include providing a pressurized admixture of a gas and water to an injection nozzle positioned within a subterranean formation; converting the pressurized admixture to the second nanogas solution via the injection nozzle positioned within a subterranean formation; injecting the second nanogas solution from the injection nozzle into the subterranean formation; and then extracting the hydrocarbon from the subterranean formation.

The nanobubbles can be composed of different gasses. For example, the nanobubbles can include or consist essentially of carbon dioxide. The nanobubbles include or consist essentially of nitrogen.

Lastly, the process can preferably include collecting a mixture of the hydrocarbon and water from the subterranean formation; and separating the hydrocarbon and the water.

What is claimed is:

1. A process comprising:

withdrawing a portion of a subterranean water;

forming a pressurized admixture of a gas and the subterranean water; then converting the pressurized admixture to a nanogas solution which includes nanobubbles and water, said nanobubbles consisting essentially of carbon dioxide nanobubbles, nitrogen nanobubbles, oxygen nanobubbles, and mixtures thereof;

injecting the nanogas solution into a subterranean formation until the subterranean water includes a minimum concentration of nanobubbles;

the nanobubbles entering interstitial space between a hydrocarbon and the subterranean formation thereby reducing interfacial tension of the hydrocarbon to the subterranean formation; and extracting the hydrocarbon from the subterranean formation.

2. The process of claim 1, wherein the subterranean water is circulated through the process of withdrawing, forming, converting, and injecting until the formation includes the minimum concentration of nanobubbles; thereafter extracting the hydrocarbon.

3. The process of claim 1, wherein the subterranean water is withdrawn to a surface located device wherein the pressurized admixture is formed within the surface located device.

4. The process of claim 3, wherein the pressurized admixture is converted to the nanogas solution by the surface located device; and then the nanogas solution is returned to the subterranean formation.

5. The process of claim 1, wherein the subterranean water is withdrawn from a first well bore and the nanogas solution is injected via a second well bore.

6. The process of claim 5, wherein the first well bore and the second well bore are fluidly connected to a single subterranean formation.

7. The process of claim 1, wherein the minimum concentration of the nanobubbles in the subterranean water is at least 0.01% of a concentration of nanobubbles in the nanogas solution.

8. The process of claim 7, wherein the minimum concentration of the nanobubbles in the subterranean water is at least 0.05% of the concentration of nanobubbles in the nanogas solution.

9. The process of claim 7, wherein the minimum concentration of the nanobubbles in the subterranean water is at least 0.1% of the concentration of nanobubbles in the nanogas solution.

10. The process of claim 7, wherein the minimum concentration of the nanobubbles in the subterranean water is at least 0.5% of the concentration of nanobubbles in the nanogas solution.

11. The process of claim 7, wherein the minimum concentration of the nanobubbles in the subterranean water is at least 1% of the concentration of nanobubbles in the nanogas solution.

12. The process of claim 1, wherein the nanogas solution reduces interfacial tension between a two-phase liquid within the subterranean formation to assist in the extraction of the hydrocarbon.

13. The process of claim 12, wherein the nanogas solution enters a pore within the subterranean formation and reduces capillary pressure in the pore to assist in the extraction of the hydrocarbon.

14. A process comprising:

injecting a first nanogas solution into a subterranean formation until a subterranean water includes a minimum concentration of nanobubbles that is at least 0.01% of a concentration of nanobubbles in the first nanogas solution, wherein the first nanogas solution causes hydrocarbon from the subterranean formation to agglomerate thereby reducing interfacial tension of the hydrocarbon to the subterranean formation, said nanobubbles consisting essentially of carbon dioxide nanobubbles, nitrogen nanobubbles, oxygen nanobubbles, and mixtures thereof; and then pressurizing the subterranean formation with a second nanogas solution; and thereafter extracting the hydrocarbon from the subterranean formation.

15. The process of claim 14 further comprising providing the first nanogas solution by withdrawing a portion of the subterranean water;

forming a pressurized admixture of a gas and the subterranean water; then converting the pressurized admixture to the first nanogas solution.

16. The process of claim 14, wherein the first nanogas solution is a nitrogen nanogas solution and the second nanogas solution is a carbon dioxide nanogas solution.

17. The process of claim 14, wherein the first nanogas solution reduces interfacial tension between a two-phase liquid within the subterranean formation to assist in the extraction of the hydrocarbon.

18. The process of claim 17, wherein the first nanogas solution enters a pore within the subterranean formation and reduces capillary pressure in the pore to assist in the extraction of the hydrocarbon.

19. The process of claim 14, wherein the second nanogas solution reduces interfacial tension between a two-phase liquid within the subterranean formation to assist in the extraction of the hydrocarbon.

20. A process comprising:

withdrawing a portion of a subterranean water that includes solids and salts;

separating the solids from the subterranean water while leaving the salts; then forming a pressurized admixture of a gas and the separated subterranean water; then converting the pressurized admixture to a nanogas solution which includes nanobubbles and water, said nanobubbles consisting essentially of carbon dioxide nanobubbles, nitrogen nanobubbles, oxygen nanobubbles, and mixtures thereof;

injecting the nanogas solution into a subterranean formation until the subterranean water includes a minimum concentration of nanobubbles that is at least 0.01% of a concentration of nanobubbles in the nanogas solution thereby reducing interfacial tension of the hydrocarbon to the subterranean formation upon entry of the nanobubbles into interstitial space disposed between the hydrocarbon and the subterranean formation, wherein the nanogas solution causes hydrocarbon from the subterranean formation to agglomerate; and then extracting the hydrocarbon.

21. The process of claim 20, wherein extracting the hydrocarbon from the subterranean formation comprises:

pressurizing the subterranean formation with a second nanogas solution; and thereafter withdrawing the hydrocarbon from the subterranean formation.

22. The process of claim 20, wherein the nanogas solution reduces interfacial tension between a two-phase liquid within the subterranean formation to assist in the extraction of the hydrocarbon.

23. The process of claim 22, wherein the nanogas solution enters a pore within the subterranean formation and reduces capillary pressure in the pore to assist in the extraction of the hydrocarbon.

* * * * *